US008847876B2

(12) United States Patent
Cho et al.

(10) Patent No.: US 8,847,876 B2
(45) Date of Patent: Sep. 30, 2014

(54) DEVICE AND METHOD FOR DRIVING LIQUID CRYSTAL DISPLAY DEVICE

(75) Inventors: Soon-Dong Cho, Gumi-si (KR); Jung-Jae Kim, Goyang-si (KR); Sang-Uk Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 276 days.

(21) Appl. No.: 12/979,969

(22) Filed: Dec. 28, 2010

(65) Prior Publication Data

US 2012/0001946 A1 Jan. 5, 2012

(30) Foreign Application Priority Data

Jul. 1, 2010 (KR) ..... 10-2010-0063348

(51) Int. Cl.

*G09G 3/36* (2006.01)
*G09G 3/34* (2006.01)
*G09G 3/20* (2006.01)

(52) U.S. Cl.

CPC ..... *G09G 3/3426* (2013.01); *G09G 3/2096* (2013.01); *G09G 2320/064* (2013.01); *G09G 2320/0646* (2013.01); *G09G 3/3648* (2013.01)
USPC ..... 345/102

(58) Field of Classification Search

None
See application file for complete search history.

(56) References Cited

U.S. PATENT DOCUMENTS 5,881,299 A * 3/1999 Nomura et al. ..... 713/324
7,460,103 B2 * 12/2008 Konno et al. ..... 345/102
7,551,341 B1 * 6/2009 Ward et al. ..... 359/259
2003/0169247 A1 * 9/2003 Kawabe et al. ..... 345/204
2006/0007103 A1 * 1/2006 Oh et al. ..... 345/102
2007/0176918 A1 * 8/2007 Aho et al. ..... 345/211
2007/0268239 A1 * 11/2007 Lin et al. ..... 345/102
2007/0296684 A1 * 12/2007 Thomas et al. ..... 345/102
2008/0150853 A1 * 6/2008 Peng et al. ..... 345/87
2008/0252590 A1 * 10/2008 Doi ..... 345/102
2009/0066631 A1 * 3/2009 Lianza ..... 345/102
2009/0115718 A1 * 5/2009 Qiao et al. ..... 345/102
2009/0184909 A1 * 7/2009 Takeda ..... 345/87
2009/0213062 A1 * 8/2009 Ng et al. ..... 345/102
2009/0289890 A1 * 11/2009 Tsuchida et al. ..... 345/102
2009/0322800 A1 * 12/2009 Atkins ..... 345/690
2010/0053046 A1 * 3/2010 Nakanishi ..... 345/82
2010/0220048 A1 * 9/2010 Yamamura et al. ..... 345/102

(Continued)

FOREIGN PATENT DOCUMENTS

CN 1619630 A 5/2005
CN 1702730 11/2005
CN 101414437 A 4/2009

*Primary Examiner* — Amare Mengistu
*Assistant Examiner* — Antonio Xavier
(74) *Attorney, Agent, or Firm* — McKenna Long & Aldridge LLP

(57) ABSTRACT

A device and method for driving a liquid crystal display device, which is capable of improving image quality and reducing power consumption by varying a light emission region of a backlight unit according to brightness characteristics of a display image, is disclosed. The driving device includes a liquid crystal panel, panel drivers, a timing controller for generating control signals to control the panel drivers, analyzing a brightness distribution of externally input image data to set the number of divisional driving regions of a backlight, and generating a dimming control signal to control the brightness of each of the divisional driving regions, and a backlight unit for divisionally setting the driving regions of the backlight according to the number of divisional driving regions and the dimming control signal and driving the driving regions according to the dimming control signal to irradiate light to the liquid crystal panel.

8 Claims, 6 Drawing Sheets

(56) References Cited

U.S. PATENT DOCUMENTS

2010/0253881 A1* 10/2010 Han et al. ..... 349/65
2010/0253882 A1* 10/2010 Han et al. ..... 349/65
2010/0328361 A1* 12/2010 Kajiyama ..... 345/690
2012/0113164 A1* 5/2012 Furukawa et al. ..... 345/690

* cited by examiner

DEVICE AND METHOD FOR DRIVING LIQUID CRYSTAL DISPLAY DEVICE

This application claims the benefit of Korean Patent Application No. 10-2010-0063348, filed on Jul. 1, 2010, which is hereby incorporated by reference as if fully set forth herein.

BACKGROUND OF THE INVENTION

1. Field of the Invention

The present invention relates to a liquid crystal display device, and more particularly, to a device and method for driving a liquid crystal display device, which is capable of improving image quality and reducing power consumption by varying a light emission region of a backlight unit according to brightness characteristics of a display image.

2. Discussion of the Related Art

With increasing adoption of information technology, demands for an image display device have been variously increased. Recently, a flat panel display device such as a Liquid Crystal Display (LCD) device, a Field Emission Display (FED) device, a Plasma Display Panel (PDP) device, or a Light Emitting Diode (LED) display device is mainly used.

An LCD device displays a desired image by adjusting transmission amount of light supplied from a backlight unit by a liquid crystal panel including a plurality of liquid crystal cells arranged in a matrix.

In the related art, fluorescent lamps have been used as the primary light sources for backlight units. However, recently, with increasing miniaturization, thinness and weight reduction of backlight units, a backlight unit using LEDs, which are advantageous in terms of power consumption, weight and luminance, as compared to fluorescent lamps, has been used.

Such a backlight unit adjusts the amount of driving current supplied to light sources such as LEDs so as to control the brightness of a backlight. In the related art, a constant brightness may be supplied to a liquid crystal display device regardless of an image displayed on the liquid crystal display device.

In the backlight of the related art, a plurality of LEDs is connected in series or in parallel so as to form a plurality of LED groups, and driving current is supplied to the LED groups so as to control the overall brightness of the backlight. However, since the plurality of LED groups generates a constant brightness or the brightnesses of the plurality of LED groups are equally varied, power consumption may be increased. For example, even when the brightness of the display image is high or low in a portion of the screen, all the LED groups generate the same amount of light in both a dark region and a bright region. Thus, power consumption is increased. In addition, in the related art, since the brightness of the backlight is kept constant or constantly varied, a lifelike image may not be displayed.

SUMMARY OF THE INVENTION

Accordingly, the present invention is directed to a device and method for driving a liquid crystal display device that substantially obviates one or more problems due to limitations and disadvantages of the related art.

An object of the present invention is to provide a device and method for driving a liquid crystal display device, which is capable of improving image quality and reducing power consumption by varying a light emission region of a backlight unit according to brightness characteristics of a display image.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a device for driving a liquid crystal display device includes a liquid crystal panel including a plurality of pixel regions and configured to display an image, a plurality of panel drivers configured to drive the liquid crystal panel, a timing controller configured to generate control signals so as to control the plurality of panel drivers, to analyze a brightness distribution of externally input image data so as to set the number of divisional driving regions of a backlight, and to generate a dimming control signal to control the brightness of each of the divisional driving regions, and a backlight unit configured to divisionally set the driving regions of the backlight according to the number of divisional driving regions and the dimming control signal and to drive the driving regions according to the dimming control signal so as to irradiate light to the liquid crystal panel.

The timing controller may include an image processing unit configured to accumulate and analyze the brightness distribution of the image data using an internal or external memory in units of at least one frame, to set the number of divisional driving regions of the backlight so as to correspond to the analyzed brightness distribution, and to generate the dimming control signal according to the brightness degree of each of the set divisional driving regions.

The image processing unit may accumulate the image data, which is sequentially input in frame units, in units of at least one frame using the internal or external memory and classify the accumulated image data into a high grayscale level, an intermediate grayscale level, and a low grayscale level according to a grayscale level thereof, and analyze the brightness distribution using the classified information, set the number of divisional driving regions according to the distribution of the high grayscale, the intermediate grayscale and the low grayscale, and generate divisional driving region information.

The backlight unit may include a backlight control unit configured to divisionally set the driving regions of the backlight using the divisional driving region information and at least one dimming control signal from the timing controller and to control on/off times of the set driving regions so as to control the amount of light supplied to the liquid crystal panel.

The backlight control unit may include a driving voltage generation unit configured to supply a driving voltage to light sources of the backlight, a driving Micro Controller Unit (MCU) configured to generate a Pulse Width Modulation (PWM) signal corresponding to a duty ratio of the dimming control signal of each of the divisional driving regions received from the timing controller, to set the driving regions of the backlight so as to corresponding to the divisional driving region information, and to generate driving current supply channel information corresponding to the set driving regions, and at least one backlight control IC configured to reset supply channels of driving currents according to the driving current supply channel information and to supply or cut off the driving currents to the reset supply channels according to the PWM signal of each of the divisional driving regions.

In another aspect of the present invention, a method for driving a liquid crystal display device includes analyzing a brightness distribution of an externally input image so as to set the number of divisional driving regions of a backlight and generating at least one dimming control signal for controlling the brightness of each of the set divisional driving regions, and divisionally setting the driving regions of the backlight according to the number of divisional driving regions and the at least one dimming control signal and driving the set driving regions according to the dimming control signal so as to irradiate light to a liquid crystal panel.

The generating of the at least one dimming control signal may include accumulating and analyzing the brightness distribution of the image data in units of at least one frame using an internal or external memory, setting the number of divisional driving regions of the backlight so as to correspond to the analyzed brightness distribution, and generating the at least one of the dimming control signal according to the brightness degree of each of the divisional driving regions.

The analyzing of the brightness distribution of the image data may include accumulating the image data, which is sequentially input in frame units, in units of at least one frame using the internal or external memory and classifying the accumulated image data into a high grayscale level, an intermediate grayscale level and a low grayscale level according to a grayscale level thereof, and the setting of the number of divisional driving regions of the backlight may include analyzing the brightness distribution using the classified information, setting the number of divisional driving regions according to the distribution of the high grayscale, the intermediate grayscale and the low grayscale, and generating divisional driving region information.

The irradiating of the light to the liquid crystal panel may include divisionally setting the driving regions of the backlight using the divisional driving region information and the at least one dimming control signal, and controlling on/off times of the set driving regions so as to control the amount of light supplied to the liquid crystal panel.

The irradiating of the light to the liquid crystal panel may include generating a PWM signal so as to correspond to a duty ratio of the dimming control signal of each of the divisional driving regions, setting the driving regions of the backlight so as to correspond to the divisional driving region information, and generating driving current supply channel information corresponding to the set driving regions, and resetting supply channels of driving currents according to the driving current supply channel information and supplying or cutting off the driving currents to the reset supply channels according to the PWM signal of each of the divisional driving regions.

In a device and method for driving the liquid crystal display device according to the embodiment of the present invention, it is possible to display a lifelike image by varying light emission regions of a backlight unit according to the brightness characteristics of a display image so as to differentiate the brightness degrees of the divided light emission regions. In a divisional driving region in which light does not need to be emitted based on the brightness distribution of the display image, power is not consumed. Accordingly, it is possible to reduce power consumption of the liquid crystal display device.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, a device and method for driving a liquid crystal display device according to an embodiment of the present invention will be described in detail with reference to the accompanying drawings.

Figure 1:
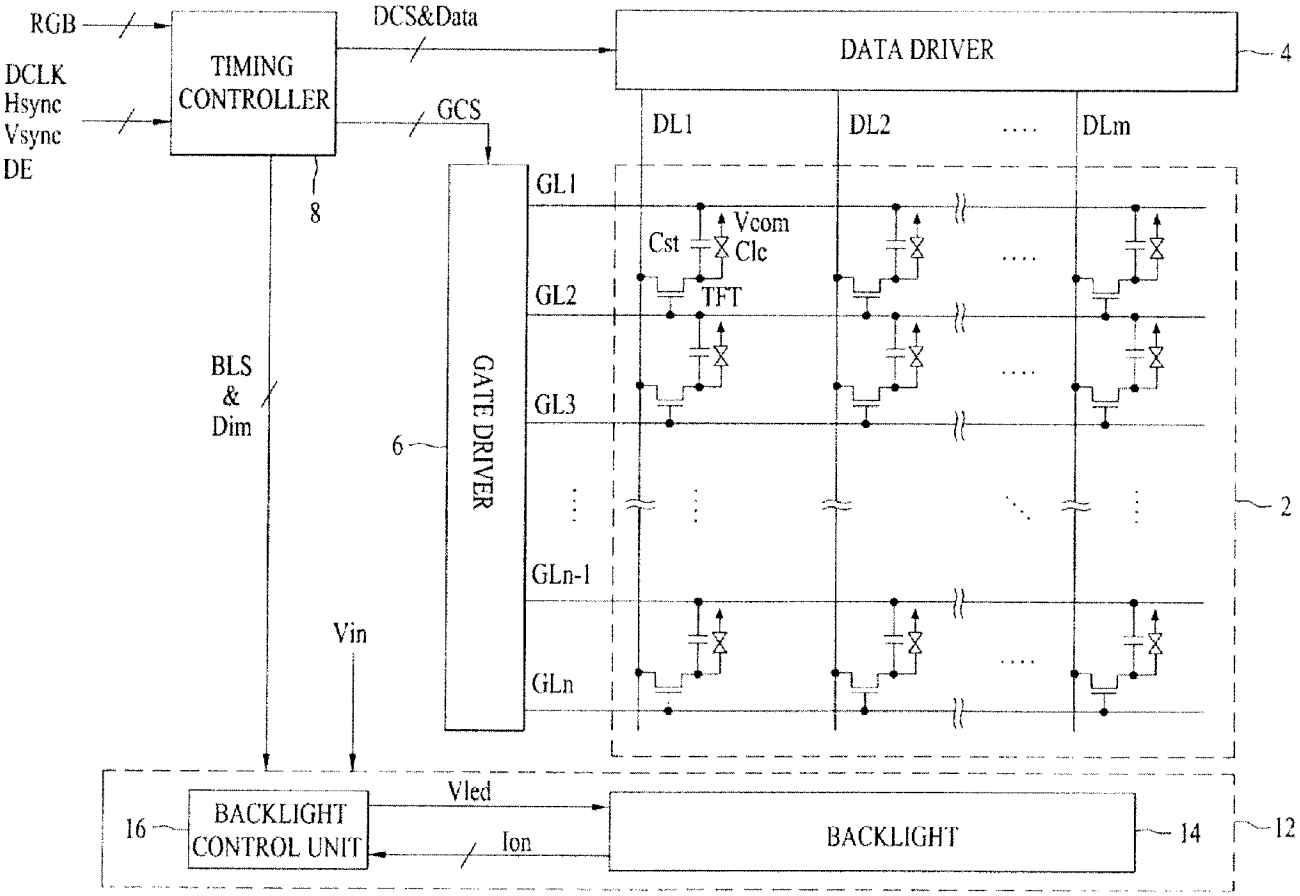
FIG. 1 is a diagram showing the configuration of a device for driving a liquid crystal display device according to an embodiment of the present invention.

FIG. 1 is a diagram showing the configuration of a device for driving a liquid crystal display device according to an embodiment of the present invention.

First, the device for driving the liquid crystal display device shown in FIG. 1 includes a liquid crystal panel 2 which includes a plurality of pixel regions and displays an image; a plurality of panel drivers 6 and 4 for driving gate and data lines GL1 to GLn and DL1 to DLm of the liquid crystal panel 2; a timing controller 8 for generating gate and data control signals GCS and DCS so as to control the plurality of panel drivers 6 and 4 and analyzing a brightness distribution of externally input image data RGB so as to set the number of divisional driving regions of a backlight 14, and generating and outputting a dimming control signal Dim for controlling the brightness of each of the set divisional driving regions; and a backlight unit 12 for divisionally setting driving regions of the backlight 14 according to the number of divisional driving regions and the dimming control signal Dim set by the timing controller 8 and driving the set driving regions according to the dimming control signal Dim so as to irradiate light to the liquid crystal panel 2.

The liquid crystal panel 2 includes Thin Film Transistors (TFTs) formed in pixel regions defined by the plurality of gate lines GL1 to GLn and the plurality of data lines DL1 to DLm and liquid crystal capacitors Clc connected to the TFTs. Each liquid crystal capacitor Clc includes a pixel electrode connected to the TFT and a common electrode facing the pixel electrode with liquid crystal interposed therebetween. The TFTs supply image signals from the data lines DL1 to DLm to the pixel electrodes in response to scan pulses from the gate lines GL1 to GLn. Each liquid crystal capacitor Clc charges a difference voltage between an image signal supplied to the pixel electrode and a common voltage supplied to the common electrode and varies arrangement of liquid crystal molecules according to the difference voltage so as to adjust light transmission, thereby implementing a grayscale display. In addition, a storage capacitor Cst is connected to the liquid crystal capacitor Clc in parallel such that the voltage charged in the liquid crystal capacitor Clc is held until a next data signal is supplied. The storage capacitor Cst may be formed by laminating the pixel electrode on a storage line with an insulating film interposed therebetween.

The panel drivers 6 and 4 include at least one gate driver 6 and at least one data driver 4. The data driver 4 converts data compensated and converted by the timing controller 8 into an analog voltage, that is, an image signal, using the data control signal DCS from the timing controller 8, for example, a Source Start Pulse (SSP), a Source Shift Clock (SSC), a Source Output Enable (SOE) signal, etc. In detail, the data driver 4 latches image data aligned through the timing controller 8 according to the SSC and then supplies an image signal of one horizontal line to each of the data lines DL1 to DLm in every horizontal period in which a scan pulse is supplied to each of the gate lines GL1 to GLn. At this time, the data driver 4 supplies a positive or negative gamma voltage with a predetermined level according to a grayscale value of the aligned image data and supplies the selected gamma voltage to each of the data lines DL1 to DLm as the image signal.

The gate driver 6 sequentially generates the scan pulse in response to the gate control signal GCS from the timing controller 8, for example, a Gate Start Pulse (GSP), a Gate Shift Clock (GSC) and a Gate Output Enable (GOE) signal and sequentially supplies the scan pulse to each of the gate lines GL1 to GLn. In other words, the gate driver 6 shifts the GSP from the timing controller 8 according to the GSC and sequentially supplies the scan pulse, for example, a gate on voltage, to each of the gate lines GL1 to GLn. In a period in which the gate on voltage is not supplied, a gate off voltage is supplied to each of the gate lines GL1 to GLn. The gate driver 6 controls the pulse width of the scan pulse according to the GOE signal.

The timing controller 8 generates the gate and data control signals GCS and DCS using at least one externally input synchronization signal, such as, a dot clock DCLK, a data enable signal DE, and horizontal and vertical synchronization signals Hsync and Vsync, and respectively supplies the gate and data control signals GCS and DCS to the gate and data drivers 6 and 4 so as to control the gate and data drivers 6 and 4.

In addition, the timing controller 8 analyzes the brightness distribution of the externally input image data RGB using an internal or external memory in units of at least one frame. The timing controller sets divisional driving region information BLS for defining and driving the backlight into one or a plurality of regions, according to the analysis result, that is, the brightness or luminance distribution of each frame of the image data RGB. Such a timing controller 8 generates the dimming control signal Dim for equally or differently controlling the brightnesses of the divisional driving regions according to the brightness distribution and supplies the dimming control signal to the backlight unit 12. Thereafter, the timing controller 8 aligns the image data RGB, the brightness distribution of which is analyzed, so as to suit the driving of the liquid crystal panel 2 and supplies the aligned image data to the data driver 4 in units of at least one horizontal line. The more detailed configuration of the timing controller 8 and the method for operating the same will be described later with reference to the accompanying drawings.

The backlight unit 12 divisionally sets the driving regions of the backlight 14 according to the number of divisional driving regions set by the timing controller 8, that is, the divisional driving region information BLS, and the dimming control signal Dim and drives the set driving regions according to the dimming control signal Dim, thereby irradiating light to the liquid crystal panel 2. The backlight unit 12 includes the backlight 14 including a plurality of light sources for generating light and an optical unit for improving efficiency of the light emitted from the plurality of light sources and the backlight control unit 16 for divisionally setting the driving regions of the backlight 14 according to the divisional driving region information BLS and the dimming control signal Dim from the timing controller 8 and controlling on/off times of the set driving regions so as to control the amount of light supplied to the liquid crystal panel 2.

The backlight 14 includes the plurality of light sources connected in series or in parallel and turns the light sources corresponding to one or more driving regions on or off according to a driving voltage Vled supplied to the light sources so as to generate light. The optical unit diffuses and focuses the light emitted from the light sources so as to improve light efficiency.

The light sources of the backlight 14 may include linear light sources, surface light sources, point light sources or a combination thereof. A Cold Cathode Fluorescent Lamp (CCFL), an External Electrode Fluorescent Lamp (EEFL), etc. may be used as the linear light source, and at least one Light Emitting Diode (LED), etc. may be used as the point light source. Hereinafter, an example of using at least one LED group, in which a plurality of LEDs is connected in series or in parallel, as the light sources of the backlight 14 will be described. Each LED group of the backlight 14 may include only white LEDs so as to generate white light or may include a combination of red, green and blue LEDs so as to generate white light.

The plurality of LED groups may be respectively defined in the driving regions and divisionally driven in the region units. The backlight 14 may be divided into 4×4, 16×16, 580×640, . . . , or n×m (here, n and m are natural integers which are equal to or different from each other) regions so as to be driven. The driving regions generate light by the driving voltage Vled, and the light emission amount, that is, the brightness, of each driving region is controlled by an LED driving current amount or a driving current supply period adjusted by an output terminal thereof.

The backlight control unit 16 sets the driving regions of the backlight 14 to 4×4, 16×16, 580×640, . . . , or n×m divisional driving regions according to the divisional driving region information BLS from the timing controller 8 and controls the on/off times of the divisional driving regions according to the dimming control signal Dim so as to control the amount of light supplied to the liquid crystal panel 2 in divisional region units. In detail, the backlight control unit 16 divides the driving regions of the backlight 14 into the n×m regions according to the divisional driving region information BLS and generates a Pulse Width Modulation (PWM) signal corresponding to a duty ratio of the dimming control signal Dim received from the timing controller 8. The PWM signal is a signal in which an on/off period, for example, a high/low period, of each LED group is varied according to the duty ratio information of the dimming control signal Dim. The backlight control unit 16 adjusts an LED driving current output time output from each driving current output terminal of the backlight 14 according to the PWM signal so as to turn each LED group on/off such that each LED group is driven in a burst mode. A more detailed configuration of the backlight control unit 16 and the method for driving the same will be given with reference to the accompanying drawings.

Figure 2:
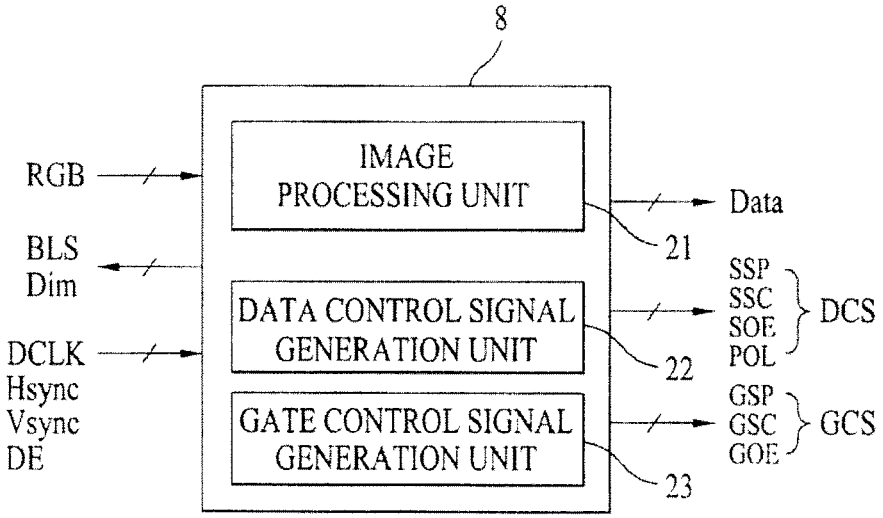
FIG. 2 is a diagram showing the configuration of a timing controller shown in FIG. 1 in detail.

FIG. 2 is a diagram showing the configuration of the timing controller shown in FIG. 1 in detail.

The timing controller 8 shown in FIG. 2 includes an image processing unit 21 for accumulating and analyzing the brightness distribution of the image data RGB using the internal or external memory in units of at least one frame, setting the number of divisional driving regions of the backlight 14 so as to correspond to the analyzed brightness distribution, and generating the dimming control signal Dim according to the brightness of each of the set divisional driving regions, a data control signal generation unit 22 for generating the data control signal DCS using at least one of the external synchronization signals DCLK, Vsync, Hsync, and DE and supplying the data control signal DCS to the data driver 4 of the plurality of panel drivers 6 and 4, and a gate control signal generation unit 23 for generating the gate control signal GCS so as to sequentially supply the gate on voltage to the gate lines GL1 to GLn of the liquid crystal panel 2 and supplying the gate control signal GCS to the gate driver 6 of the plurality of panel drivers 6 and 4.

The image processing unit 21 accumulates the image data RGB, which is sequentially input in frame units, in units of at least one frame using the internal or external memory. At this time, the image processing unit 21 classifies the accumulated image data into a high grayscale level, an intermediate grayscale level and a low grayscale level according to a grayscale level thereof and analyzes the brightness distribution using the classified information in units of at least one frame. The number of divisional driving regions is set according to the distribution of the high grayscale level, the intermediate grayscale level and the low grayscale level so as to generate the divisional driving region information BLS.

Figure 3A:
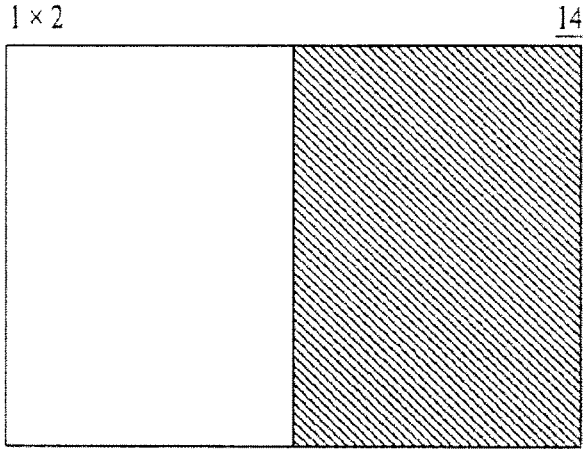
FIGS. 3A to 3D are diagrams illustrating a method of setting divisional driving regions of a backlight shown in FIG. 1.
Figure 3B:
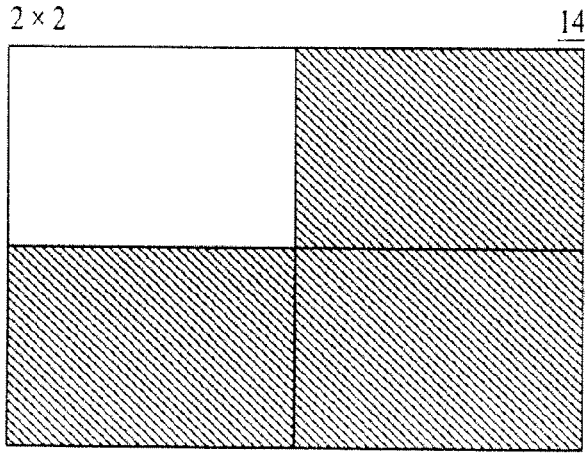

This will be described in more detail with reference to FIGS. 3A to 3D. First, FIG. 3A shows the case where bright image data with high grayscale or dark image data with low grayscale is widely distributed. In this case, the number of divisional driving regions is set to a small value, that is, 1×1, 2×2, . . . , 3×3 or the like so as to set the size of the divisional driving regions to be large. In other words, if bright regions or dark regions are densely distributed in any one portion of the liquid crystal panel 2, the number of divisional driving regions is set to a small value as shown in FIG. 3A or 3B so as to set the size of the divisional driving regions of the backlight 14 corresponding to the liquid crystal panel 2 to be large. If the number of divisional driving regions is set to a small value so as to set the size of the divisional driving regions to be large, reduction in power consumption of the backlight 14 is increased and thus reduction in power consumption of the liquid crystal display device is increased.

Figure 3C:
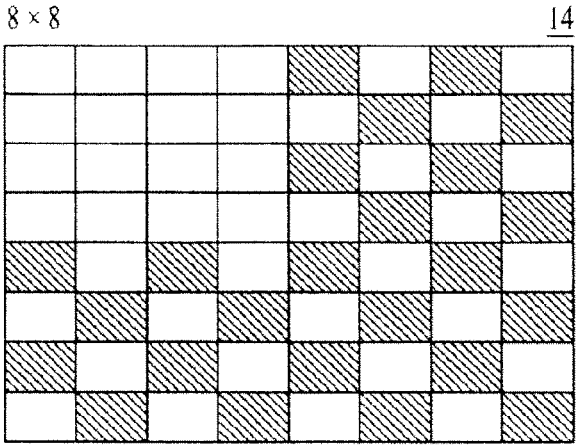

In contrast, if the area of a region in which bright image data with high grayscale is densely distributed is small, as shown in FIG. 3C, the number of divisional driving regions is increased so as to set the size of the bright display region to be small. Alternatively, the number of divisional driving regions may be adjusted according to the distribution of dark image data with low grayscale such that the regions appear dark. As shown in FIG. 3C, although the number of divisional driving regions is large, bright image data with high grayscale is densely distributed in a portion of the liquid crystal panel, the portion may appear bright. In this case, the dimming control signal Dim may be generated and applied such that the portion is brightly displayed.

Figure 3D:
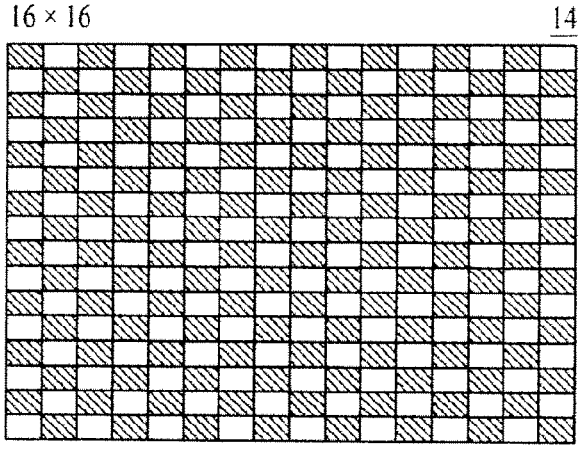

As shown in FIG. 3D, if image data with intermediate grayscale is uniformly distributed or if image data with low grayscale and high grayscale is uniformly distributed, the brightness of the backlight 14 may be set to be uniformly distributed in the entire region. In this case, the number of divisionally driving regions may be maximally set.

If the number of divisional driving regions is set as described above, the image processing unit 21 generates the dimming control signal Dim corresponding to each divisional driving region according to the brightness degree of each divisional driving region, that is, the accumulated grayscale level of each divisional driving region. The set divisional region information BLS and the dimming control signals Dim are sequentially supplied to the backlight control unit 16. If dimming control signals Dim having different sizes are generated and applied according to the accumulated grayscale level of each divisional driving region, it is possible to display a lifelike image according to the brightness of each region.

The image processing unit 16 aligns the image data RGB using at least one of the synchronization signals DCLK, Hsync, Vsync and DE so as to suit the driving of the liquid crystal panel 2 and supplies the aligned image data to the data driver 4.

Referring to FIG. 2, the data control signal generation unit 22 of the timing controller 8 generates the SOE, the SSC, the SSP and a POL, signal which is a polarity control signal, using at least one of the synchronization signals DCLK, DE, Hsync and Vsync, for example, the data enable signal DE and the vertical synchronization signal Vsync. At this time, the data control signal generation unit 22 converts the voltage level of the POL signal according to a predetermined inversion method of the liquid crystal panel 2 and generates the data control signal. The generated data control signal is supplied to the data driver 4.

The gate control signal generation unit 23 generates the GOE, the GSP and the GSC, that is, the gate control signal GCS, using at least one of the synchronization signals DCLK, DE, Hsync and Vsync and supplies the generated gate control signal GCS to the gate driver 6. The gate control signal GCS is a signal for controlling the driving timing of the gate driver 6, that is, a signal generated such that the gate driver 6 sequentially supplies the gate on voltage to the gate lines GL1 to GLn.

Figure 4:
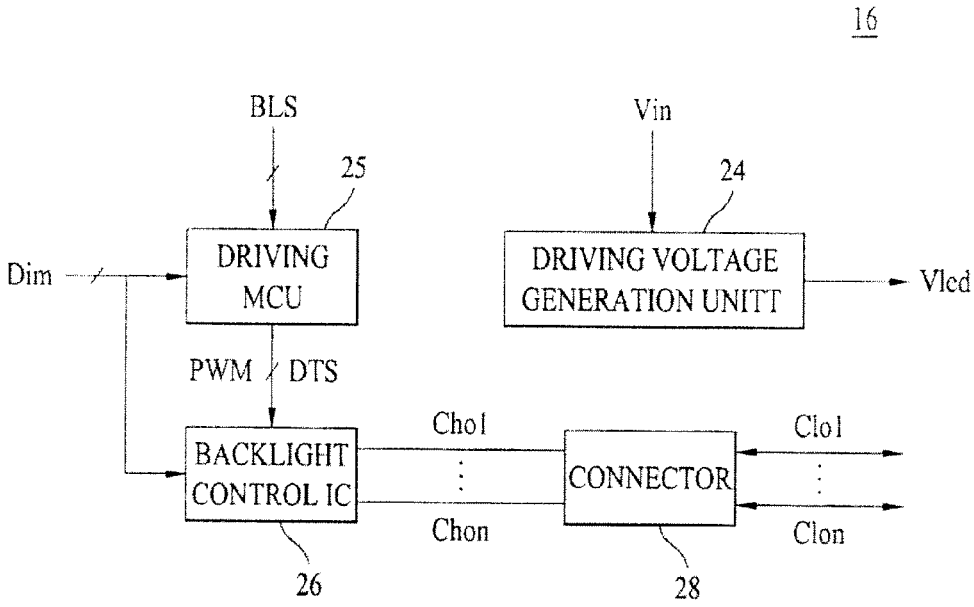
FIG. 4 is a diagram showing the configuration of a backlight control unit shown in FIG. 1 in detail.

FIG. 4 is a diagram showing the configuration of the backlight control unit shown in FIG. 1 in detail.

The backlight control unit 16 shown in FIG. 4 includes a driving voltage generation unit 24 for supplying the driving voltage Vled to the light sources of the backlight 14, a driving Micro Controller Unit (MCU) 22 for generating the PWM signal corresponding to the duty ratio of the dimming control signal Dim of each divisional driving region received from the timing controller 8, setting the driving regions of the backlight 14 according to the divisional driving region information BLS, and generating driving current supply channel information DTS corresponding to the set driving regions, and at least one backlight control IC 26 for resetting supply channels Cho1 to Chon of driving currents CIo1 to CIon according to the driving current supply channel information DTS and supplying or cutting off the driving current CIo1 to CIon to the reset supply channels Cho1 to Chon according to the PWM signal of each divisional driving region.

At least one connector 28 is further included between each light source of the backlight 14, for example, the output terminal of each LED group, and each backlight control IC 26 so as to more stably supply each of the driving currents CIo1 to CIon from the output terminal of each LED group to the backlight control IC 26.

The driving voltage generation unit 24 simultaneously or sequentially generates the driving voltage Vled suitable for driving a plurality of LED groups, for example, a minimum unit driving region, using an external voltage signal Vin and simultaneously and sequentially supplies the driving voltage to each of the plurality of LED groups. The driving voltage generation unit 24 may further include at least one register for storing data about characteristics of the driving voltage Vled supplied to each LED group, that is, characteristics of current amount and voltage level of each driving voltage Vled. If the driving current amounts or voltage levels are different due to a difference between the colors or characteristics of the LEDs included in each LED group, the driving voltage Vled may be generated so as to suit the driving characteristics of each LED group and may be supplied to each LED group.

Figure 5:
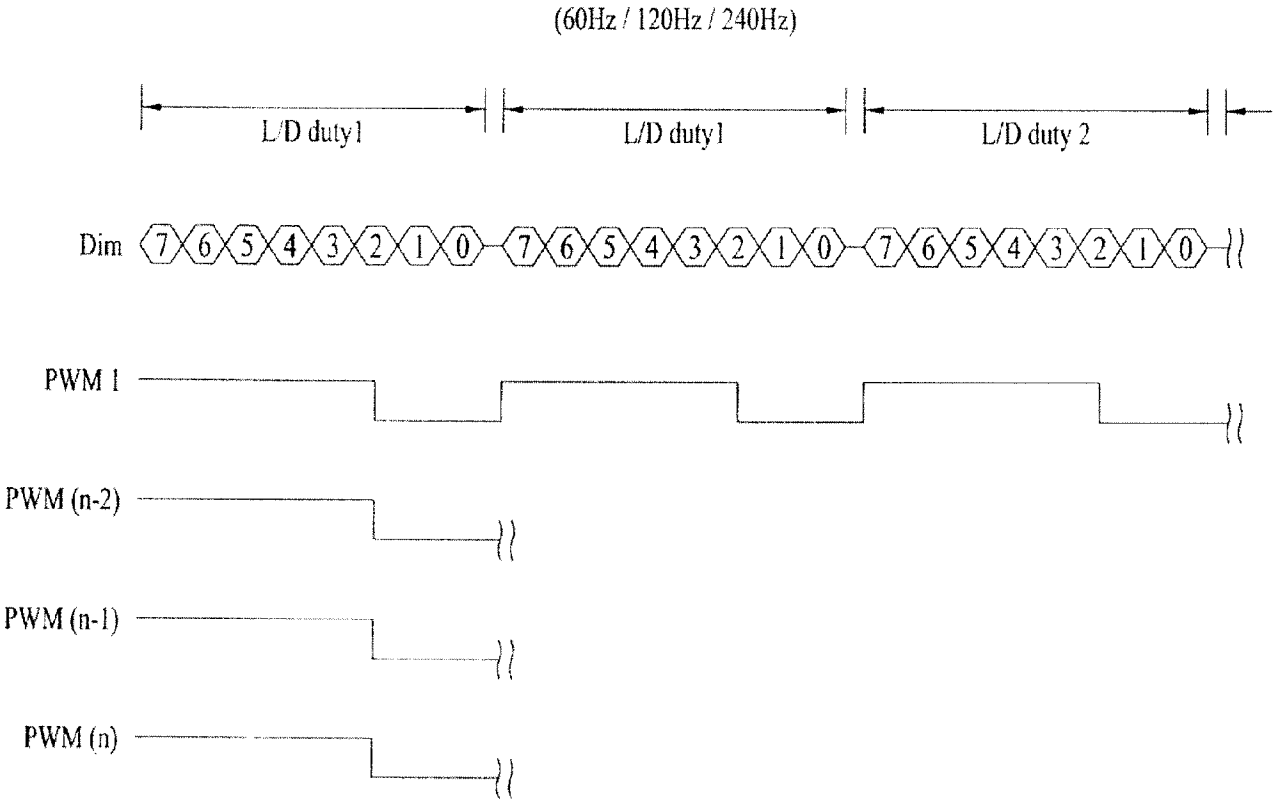
FIG. 5 is a diagram showing a dimming control signal from the timing controller and PWM signals associated therewith.

FIG. 5 is a diagram showing the dimming control signal from the timing controller and PWM signals associated therewith.

Referring to FIG. 5, the operations of the driving MCU 25 and the backlight control IC 26 shown in FIG. 4 will be described in detail. The driving MCU 25 generates at least one PWM signal corresponding to the duty ratio of the dimming control signal Dim of each divisional driving region received from the timing controller 8. Since the dimming control signal Dim includes information about the duty ratio for turning the LED groups on, each PWM signal is held at a high state in a period corresponding to 50% of a frame period if the duty ratio of the dimming control signal Dim is 50% and is held at a high state in a period corresponding to 30% of a frame period if the duty ratio of the dimming control signal Dim is 30%. The PWM signal is held at a low state in the period other than the period when the PWM signal is held at the high state.

The driving MCU 25 generates and supplies the driving current supply channel information DTS to the backlight control IC 26 such that the LED groups of the backlight 14 are included in the respective driving regions according to the divisional driving region information BLS so as to receive the respective driving currents CIo1 to CIon in driving region units.

At least one backlight control IC 26 resets the supply channels Ch01 to Chon of the driving currents CIo1 to CIon in divisional driving region units according to the driving channel supply channel information DTS from the driving MCU 25. The brightness of each driving regions of the backlight 14 is controlled by supplying or cutting off the driving currents CIo1 to CIon to the reset supply channels Cho1 to Chon according to the PWM signal of each divisional driving region.

As described above, in the device and method for driving the liquid crystal display device according to the embodiment of the present invention, the brightness distribution of the display image data RGB is analyzed and the light emission regions of the backlight 14 are divisionally driven according to the result of analysis. Accordingly, it is possible to display a lifelike image by differentiating the brightness degrees of the divided light emission regions. In a divisional driving region in which light does not need to be emitted based on the brightness distribution of the display image, power is not consumed. Accordingly, it is possible to reduce power consumption of the liquid crystal display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A device for driving a liquid crystal display device, the device comprising:

a liquid crystal panel including a plurality of pixel regions and configured to display an image;

a plurality of panel drivers configured to drive the liquid crystal panel;

a timing controller configured to generate control signals so as to control the plurality of panel drivers, to analyze a brightness distribution of externally input image data so as to set a size and number of N×M (where N and M are integers which are equal to or different from each other) divisional driving regions of a backlight to dynamically control a brightness of the divisional driving regions, and to generate a dimming control signal to uniformly control the brightness of each of the divisional driving regions; and a backlight unit configured to divisionally set the driving regions of the backlight according to the size and number of N×M divisional driving regions and the dimming control signal and to control on/off times of the N×M divisional driving regions according to the dimming control signal so as to irradiate light to the liquid crystal panel, wherein the timing controller includes an image processing unit configured to accumulate and analyze the brightness distribution of image data using an internal or external memory in units of at least one frame, to set the size and number of the N×M divisional driving regions of the backlight according to the distribution of a high grayscale level, an intermediate grayscale level and a low grayscale level, and generate divisional driving region information, and to generate the dimming control signal according to an accumulated grayscale level of each of the set N×M divisional driving regions, wherein the size and number of the N×M divisional driving regions to dynamically control the brightness of the divisional driving regions is changed according to the brightness distribution of the units of at least one frame, and a number of the dimming control signal is also changed same as the changed number of divisional driving regions, wherein when an area of a region having one of the high grayscale level and low grayscale level is densely distributed, then the number of N×M divisional driving regions is decreased and a size of the densely distributed area is large in a portion of the LCD panel such that the portion has uniform brightness, and wherein when the image data having the intermediate grayscale level, high grayscale level or low grayscale level is uniformly distributed, then the number of N×M divisional driving regions is increased and brightness is uniformly distributed in the entire region.

2. The device according to claim 1, wherein the image processing unit is configured to:

accumulate the image data, which is sequentially input in frame units, in units of at least one frame using the internal or external memory and classifies the accumulated image data into the high grayscale level, the intermediate grayscale level and the low grayscale level according to the grayscale level thereof, and analyze the brightness distribution using the classified information, change the number of divisional driving regions, and generate divisional driving region information.

3. The device according to claim 2, wherein the backlight unit includes a backlight control unit configured to divisionally set the driving regions of the backlight using the divisional driving region information and at least one dimming control signal from the timing controller and to control on/off times of the set driving regions so as to control the amount of light supplied to the liquid crystal panel.

4. The device according to claim 3, wherein the backlight control unit includes:

a driving voltage generation unit configured to supply a driving voltage to light sources of the backlight;

a driving Micro Controller Unit (MCU) configured to generate a Pulse Width Modulation (PWM) signal corresponding to a duty ratio of the dimming control signal of each of the divisional driving regions received from the timing controller, to set the driving regions of the backlight so as to correspond to the divisional driving region information, and to generate driving current supply channel information corresponding to the set driving regions; and at least one backlight control IC configured to reset supply channels of driving currents according to the driving current supply channel information and to supply or cut off the driving currents to the reset supply channels according to the PWM signal of each of the division driving regions.

5. A method for driving a liquid crystal display device, the method comprising:

analyzing a brightness distribution of an externally input image so as to set a size and number of N×M (where N and M are integers which are equal to or different from each other divisional driving regions of a backlight to dynamically control a brightness of the divisional driving regions and generating at least one dimming control signal for uniformly controlling the brightness of each of the N×M divisional driving regions; and divisionally setting the driving regions of the backlight according to the size and number of the N×M divisional driving regions and the at least one dimming control signal and controlling on/off times of the set driving regions according to the dimming control signal so as to irradiate light to a liquid crystal panel, wherein the generating of the at least one dimming control signal includes:

accumulating and analyzing the brightness distribution of the image data in units of at least one frame using an internal or external memory;

setting the size and number of the N×M divisional driving regions of the backlight according to the distribution of a high grayscale level, an intermediate grayscale level and a low grayscale level, and generate divisional driving region information; and generating the at least one of the dimming control signal according to accumulated grayscale levels of each of the N×M divisional driving regions, wherein size and the number of the N×M divisional driving regions to dynamically control the brightness of the divisional driving regions is changed according to the brightness distribution of the units of at least one frame, and a number of the dimming control signal is also changed same as the changed number of divisional driving regions, wherein when an area of a region having one of the high grayscale level and low grayscale level is densely distributed, then the number of N×M divisional driving regions is decreased and a size of the densely distributed area is large in a portion of the LCD panel such that the portion has uniform brightness, and wherein when the image data having the intermediate grayscale level, high grayscale level or low grayscale level is uniformly distributed, then the number of N×M divisional driving regions is increased, and brightness is uniformly distributed in the entire region.

6. The method according to claim 5, wherein:

the analyzing of the brightness distribution of the image data includes accumulating the image data, which is sequentially input in frame units, in units of at least one frame using the internal or external memory and classifying the accumulated image data into the high grayscale level, the intermediate grayscale level and the low grayscale level according to a grayscale level thereof, and the setting of the number of divisional driving regions of the backlight includes analyzing the brightness distribution using the classified information, and changing the number of divisional driving regions.

7. The method according to claim 6, wherein the irradiating of the light to the liquid crystal panel includes:

divisionally setting the driving regions of the backlight using the divisional driving region information and the at least one dimming control signal; and controlling on/off times of the set driving regions so as to control the amount of light supplied to the liquid crystal panel.

8. The method according to claim 7, wherein the irradiating of the light to the liquid crystal panel includes:

generating a PWN signal so as to correspond to a duty ratio of the dimming control signal of each of the divisional driving regions, setting the driving regions of the backlight so as to correspond to the divisional driving region information, and generating driving current supply channel information corresponding to the set driving regions; and resetting supply channels of driving currents according to the driving current supply channel information and supplying or cutting off the driving currents to the reset supply channels according to the PWM signal of each of the divisional driving regions.

* * * * *